US006233414B1

(12) United States Patent
Farrell

(10) Patent No.: US 6,233,414 B1
(45) Date of Patent: May 15, 2001

(54) METHODS AND SYSTEMS FOR PROVIDING CAPABILITY AND STATUS INDICATION OF AN IMAGING SYSTEM

(75) Inventor: Michael Eugene Farrell, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/492,311

(22) Filed: Jan. 27, 2000

(51) Int. Cl.[7] ..... G03G 15/00
(52) U.S. Cl. ..... 399/81; 399/83
(58) Field of Search ..... 399/81, 82, 83, 399/85, 8

(56) References Cited

U.S. PATENT DOCUMENTS 5,061,958 * 10/1991 Bunker et al. ..... 399/81
5,614,993 * 3/1997 Smith et al. ..... 399/81
5,872,569 * 2/1999 Salgado et al. ..... 345/349
5,880,727 * 3/1999 Barrett et al. ..... 345/357
6,058,277 * 5/2000 Streefkerk et al. ..... 399/81

* cited by examiner

*Primary Examiner*—Robert Beatty
(74) *Attorney, Agent, or Firm*—Oliff & Berridge, PLC.

(57) ABSTRACT

Status information control methods and status information control systems allow operators to define the criteria that provides a "ready" indication for an image forming device. An operator determines a number of required features for an output job. The control systems then monitor a selected image forming device to determine if the selected image forming device has all of the required features and if all the required features are available. If the selected image forming device has all the required features and if they are available, a "ready" status is indicated, otherwise a "not ready" status is indicate .Alternatively, the status confirmation control methods and systems allow operators to track an output job by displaying detailed information about an image form device's features and each feature's availability.

17 Claims, 9 Drawing Sheets

METHODS AND SYSTEMS FOR PROVIDING CAPABILITY AND STATUS INDICATION OF AN IMAGING SYSTEM

BACKGROUND OF THE INVENTION

1. Field of Invention

This invention is directed to methods and systems for providing feature and status information for image forming devices.

2. Description of Related Art

Image forming devices have long offered users a single status indication that represents the device's ability to operate. Conventionally, as long as an image forming device could produce a single page, the image forming device would display the same ready status indication as a fully functional image forming device. As a result, operators using a partially disabled image forming device might not receive notice about the image forming device's problems. Thus, the operators would continue to send output requests to that image forming device and the requested output jobs might not be timely completed.

SUMMARY OF THE INVENTION

Methods and systems that provide operators with more accurate and relevant status information for various image forming devices that is easily interpreted are desirable. As different operators often have different requirements for an image forming device, it becomes convenient for each operator to define exactly what information a ready indication should define. By customizing the ready indication, operators can receive exactly the status information they require using a single indicator.

As an alternative to using a single status indicator, it becomes convenient for operators to view a detailed representation of an image forming device's features along with an availability and use of each feature. By viewing such a detailed representation, an operator can monitor the availability and use of the image forming device's features, in effect, tracking both the status of the image forming device and progress of an output job.

This invention provides methods and systems that allow operators to define the criteria that provides a "ready" indication for an image forming device.

In various exemplary embodiments, systems and methods according to this invention include a user interface and one or more image forming devices having one or more output features. An operator determines a number of required features for an output job, the systems and methods then monitor a selected image forming device to determine if the selected image forming device has all of the required features and if all the required features are available. If the selected image forming device has all the required features and if the required features are all available, a "ready" status is provided to the user; otherwise a "not ready" status is provided to the user.

In a second exemplary embodiment of the methods and systems of this invention, operators are able to track an output job by receiving updated detailed information about an image forming device's features, the availability and the use of the features. The systems and methods include a user interface and one or more image forming devices having one or more output features. The systems and methods monitor a selected image forming device as that image forming device processes an output job, displays the selected image forming device's features, the availability and use of the features and updates the display to reflect changes in the availability and use of the features as the output job progresses.

BRIEF DESCRIPTION OF THE DRAWINGS

The invention is described in detail with reference to the following figures, wherein like numerals reference like elements, and wherein.

DETAILED DESCRIPTION OF PREFERRED EMBODIMENTS

As an operator is often only concerned whether an image forming device can complete an output job without becoming mired in detail, a single "ready/not ready" indication regarding an image forming device's capabilities can be desirable, even when the output job requires sophisticated and detailed instructions and the image forming device is complex. By defining exactly what information the ready status indication should define, operators can receive exactly the status information they require using the single status indicator.

As an alternative to the single status indicator, an operator can opt to view a display containing detailed information about an image forming device's features along with the availability and use of each feature.

Figure 1:
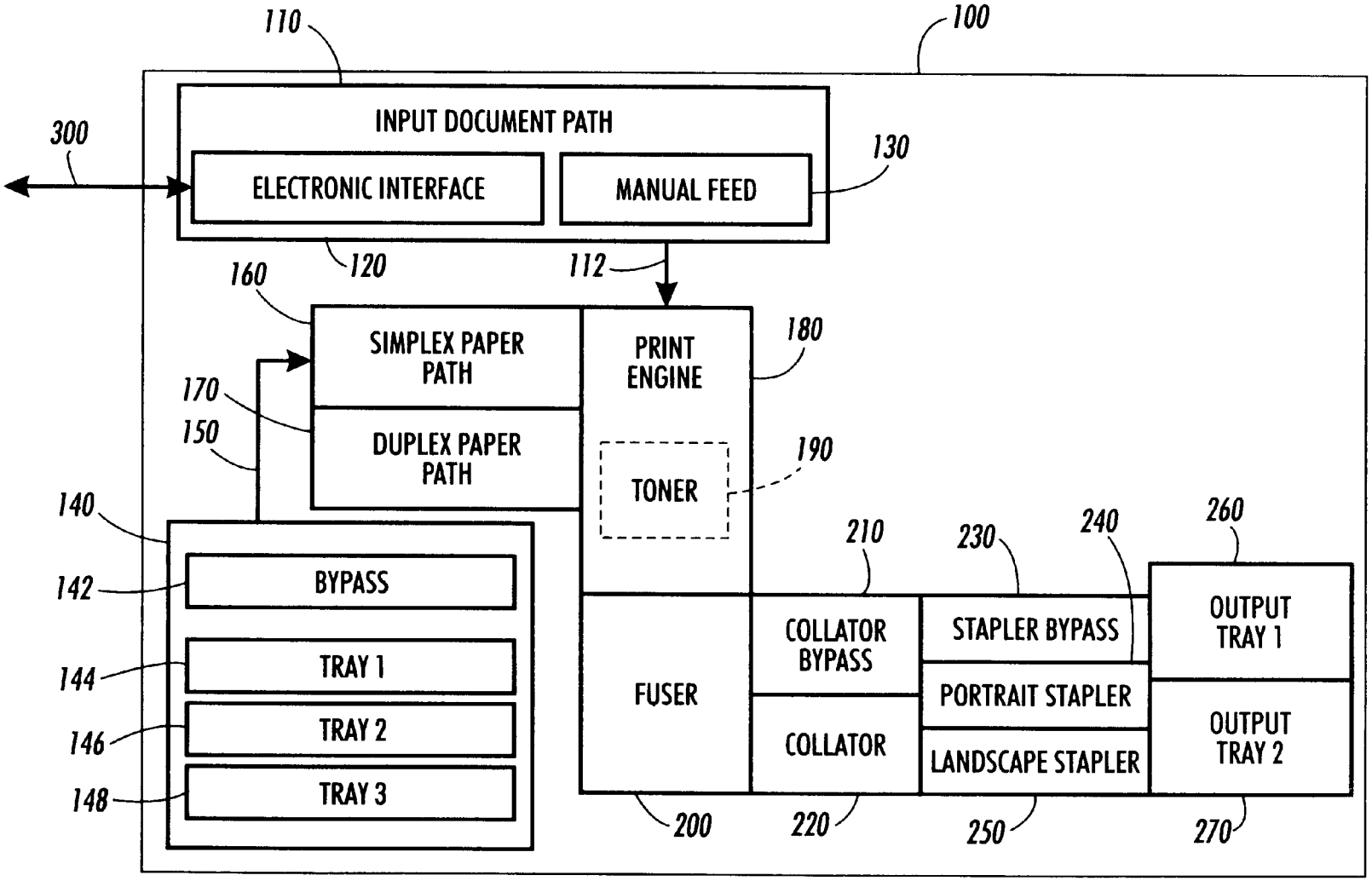
FIG. 1 is a diagram illustrating one exemplary embodiment of an image forming device according to this invention.

FIG. 1 is a functional block diagram of an image forming device 100 for outputting images according to this invention. The image forming device 100 includes some or all of an input document path 110 with an electronic interface 120 and an original document feeder 130, a paper supply module 140 with a paper bypass path 142 and three paper trays 144, 146 and 148, a feed paper path 150, a simplex paper path 160, a duplex paper path 170, a print engine 180, a toner module 190, a fuser module 200, a collator bypass path 210, a collator 220, a stapler bypass path 230, a portrait stapler 240, a landscape stapler 250, a first output tray 260 and a second output tray 270.

In operation, the input document path 110 receives image output jobs either using the electronic interface 120 and a link 300 or using the original document feeder 130. The output job can contain an image to be formed by the image forming device 100 and a set of instructions relating to the image. The instructions can include directions such as the type of paper onto which the image is to be formed, whether the image requires simplex or duplex image forming, whether the pages of the image are to be collated, whether the pages of the image output job are to be stapled and, if so, how they are to be stapled, and what output tray the image output job is to be deposited.

Upon receiving instructions from the input document path 110 0, the image forming device 100 selects the required paper type as determined by the instructions from the paper supply module 140, either using the paper bypass 142 or by drawing image recording sheets from one of the three paper trays 144, 146 or 148. Upon selecting the appropriate paper type, the image forming module 140 feeds the sheet to the simplex paper path 160 via the feed paper path 150, If one-sided image forming is desired, only the simplex paper path 160 and print engine 180 are required. However, if two-sided image forming is desirable, the duplex paper path 170 is also required. As the image output job is processed, the print engine 180, using the simplex and duplex paper paths 160 and 170 and the toner module 190, forms a toner image on the sheet taken from the paper supply module 140.

After the image is formed, the print engine 180 hands the sheet to the fuser 200 to fix the toner image to the sheet. Next, the sheet is fed to either the collator bypass 210 or the collator 220, depending on whether the sheets are to be collated into multiple packages or gathered into a single package. The one or more packages of sheets are then fed to either the stapler bypass path 230, the portrait stapler 240 or the landscape stapler 250 according to the instructions from the input document path 110. Finally, the sheets of the output job are handed to either the first or second output trays 260 or 270 as directed, from which an operator can remove the one or more packages of sheets.

Figure 2:
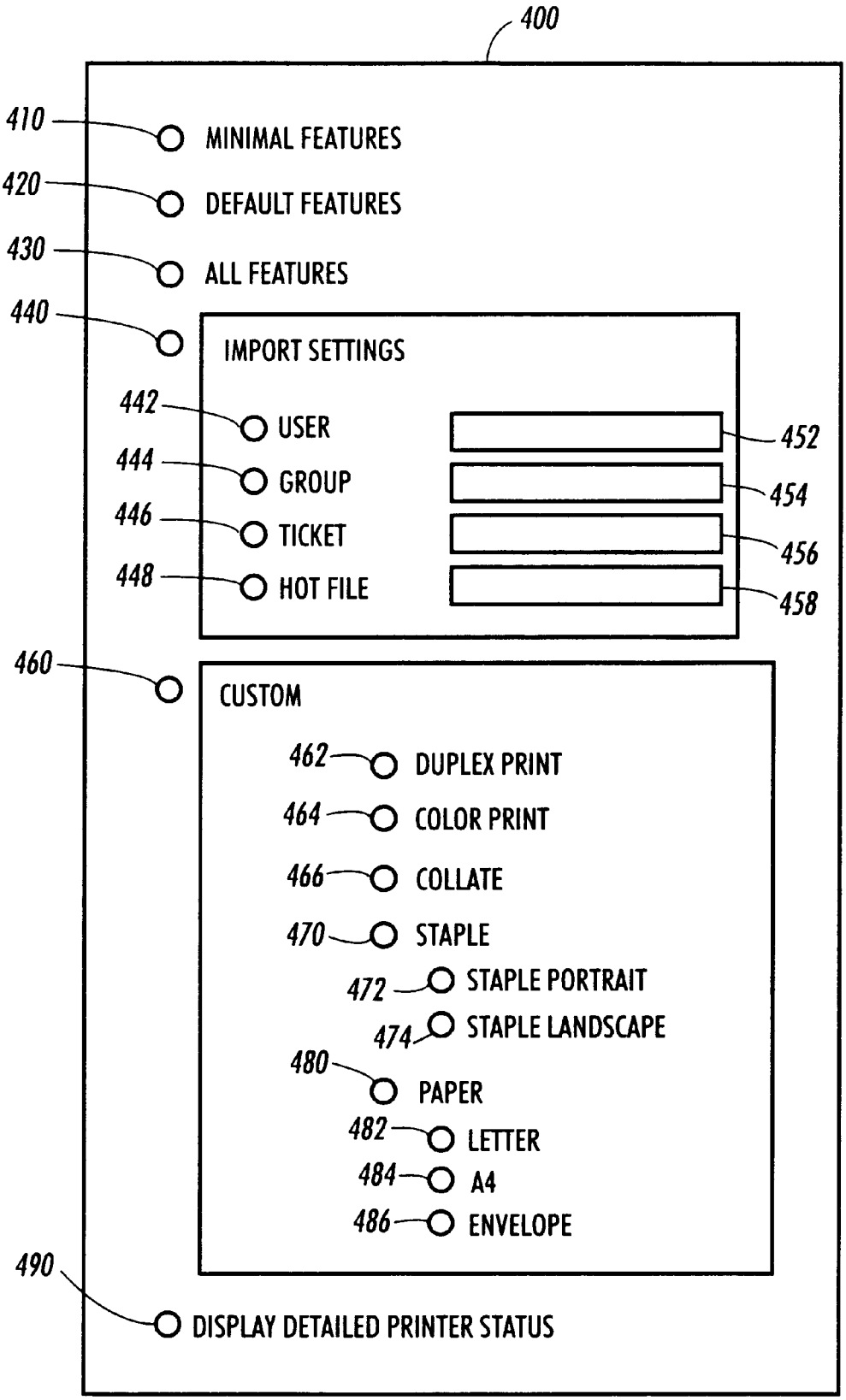
FIG. 2 is a diagram illustrating one exemplary embodiment of a graphical user interface usable to define the criteria to be used to determine a status indication according to this invention.

FIG. 2 shows an exemplary feature selection graphical user interface 400 containing a number of selection widgets 410–490 that can be used to define a set of required image forming device features to be used by the image forming device 100 when generating status information. The exemplary feature selection graphical user interface 400 can define a variety of logical conditions that an image forming device 100 needs to satisfy in order to return a "ready" status indication. As the exemplary feature selection graphical user interface 400 illustrates only a subset of the possible features available to known image forming device systems, it should be appreciated that the exemplary feature selection graphical user interface 400 is meant to be illustrative and not limiting.

As shown in FIG. 2, the graphical user interface 400 includes a minimal feature requirement button 410 that, when selected, instructs the image forming device 100 to return a "ready" status indication if the image forming device 100 is capable of printing at least one image using any set of image forming device features.

The exemplary feature graphical user interface 400 also has a user default option setting 420 that, when selected, instructs the image forming device 100 to return a "ready" status indication only if the image forming device 100 has all the features as defined by a predetermined set of default features and only if all of the default features are available. It should be appreciated, however, that predetermined default settings are typically user-modifiable for each instance of a print instruction setting accelerator. Output instruction setting accelerators take a variety of forms including virtual printers, print queues, hot folders and saved job tickets. For example, a user may have multiple instances of each of one or more print instruction setting accelerators for a single physical image forming device, where each instance of a particular print instruction setting accelerator has different predetermined default settings.

The feature selection graphical user interface 400 also has an "All" option button 430 that, when selected, instructs an image forming device 100 to return a ready status indication only if every feature provided in the image forming device 100 is available. By selecting this option, the image forming device 100 can return a "not ready" status indication even if an unavailable feature of the image forming device 100 will not be used by an output job.

The feature selection graphical user interface 400 also has an import setting portion 440. The operator uses the import setting portion 440 to associate a particular image forming device status with one of various predetermined settings for a specific user or a user class, a virtual printer or print queue, a saved job ticket file, or a "hot folder" as employed on SCITEX products. Accompanying each of the four selection widgets 442–448 are four data entry boxes 452–458 that accept specific file names or other information that can define a set of required features. The import setting portion 440 has, as the corresponding selection widgets, four check boxes or radio buttons 442–448 that allow the user to select or enable a particular user profile, a particular group profile, a particular job or a particular hot file, respectively. When one of the selection widgets 442–448 is selected or enabled, the menu 400 accesses the predefined set of required print features identified in the corresponding data entry box 452–458. In various exemplary embodiments, the selection widgets are check boxes, however, it should be appreciated that the selection widgets can also be radio buttons, virtual switches, including multiple pole switches, or the like, without departing from the spirit and scope of the present invention.

The exemplary feature selection graphical user interface 400 also has a custom requirement portion 460 that an operator can use to compile a set of individual features usable to define the status for the image forming device 100. The custom requirement portion 460 of the exemplary menu 400 has a duplex selection widget 462, a color print selection widget 464 and a collate selection widget 466. Each widget 442–448, when selected, can cause an image forming device 100 to return a "ready" indication only if the image forming device has the selected features and only if the selected features are available.

The custom requirement portion 460 also has a staple feature selection widget 470 that, when selected, can require the image forming device 100 to have a functioning stapler to return a "ready" status. Furthermore, the custom requirement portion 460 has a staple portrait selection widget 472 and a staple landscape selection widget 474 that, when selected, causes the image forming device 100 to return a "not ready" status indication unless the image forming device 100 has a functional stapler of the particular type requested.

The exemplary custom requirement portion 460 also has a paper feature selection widget 480, a standard letter-sized paper selection widget 482, A4 paper size selection widget 484 and an envelopes selection widget 486. If any of the paper check boxes 480–486 in the feature selection graphical user interface 400 are selected, then the image forming device 100 will return a "ready" status only if the image forming device 100 has the requested paper feature and only if the requested feature is available, i.e., only if the tray holding the required paper type is not empty.

Finally, the exemplary feature selection graphical user interface 400 has a "display detailed printer information"

selection widget 490. By selecting the "display detailed printer information" selection widget 490, the user can receive detailed status and feature information from the image forming device 100. For example, an operator selecting the "display detailed printer information" selection widget 490 can view a pictorial representation of an image forming device 100 with icon-based representations of the image forming device's various features. Each such icon represents not only a feature, but also conveys status and use information.

For example, a representation of an image forming device can have a selectable element representing a collator, where a first graphic for the collator selectable element indicates the collator is ready, a second graphic indicates that the collator is in a fault condition and a third graphic that indicates that the collator is presently occupied by a previous output job. Other representations can include a screen containing binary indicators, panels of lights, textual messages and the like. It should be appreciated that any known or later developed visual representation technique capable of conveying feature and status information can be used without departing from the spirit and scope of this invention.

Figure 3:
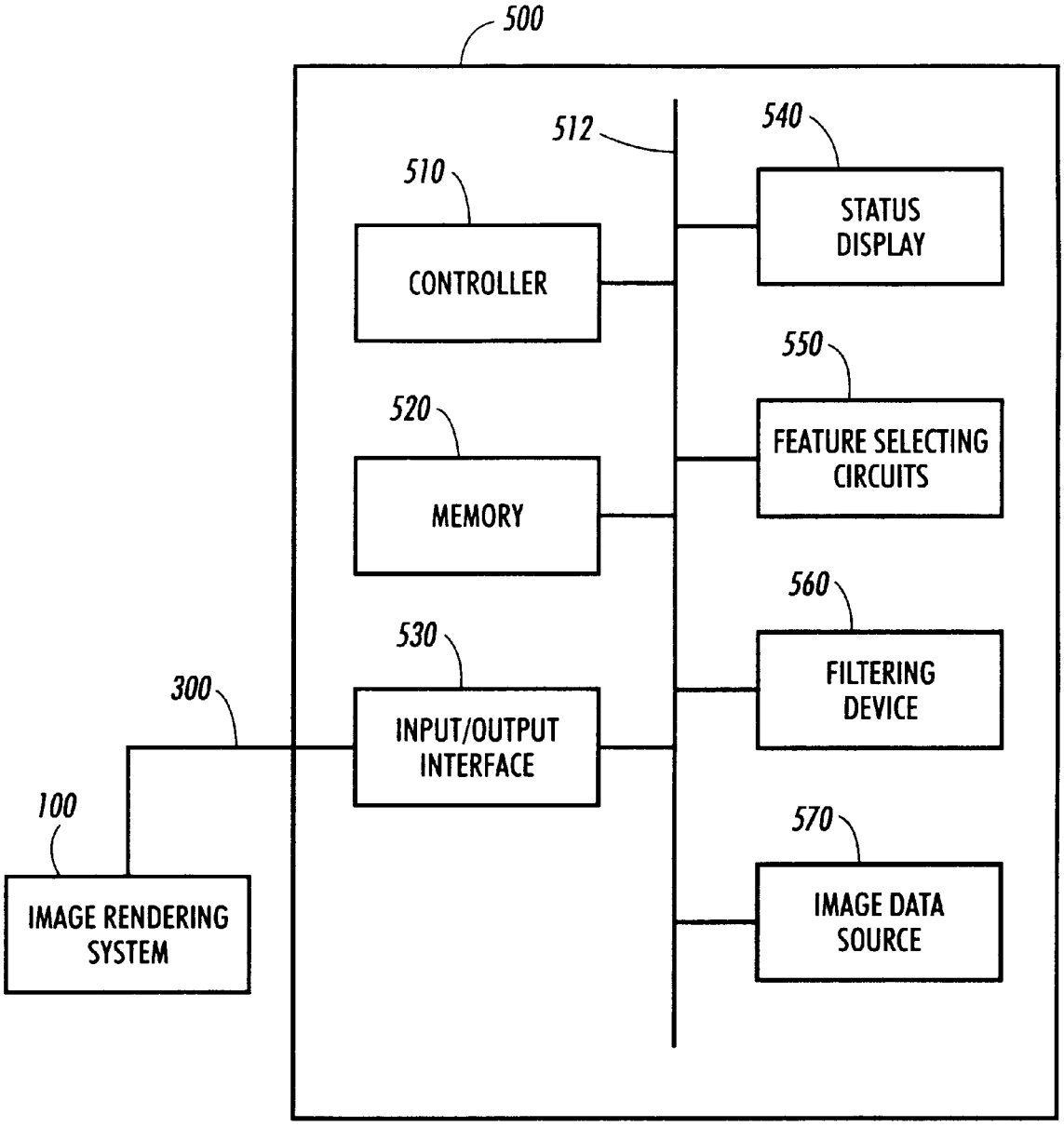
FIG. 3 is a block diagram illustrating one exemplary embodiment of a system for defining ready criteria, monitoring the status of various features of an image forming device and generating a status indication according to this invention.

FIG. 3 shows a block diagram of one exemplary embodiment of a status display and control system 500 according to this invention. The status display and control system 500 has a controller 510, a memory 520, an input/output interface 530, a status display 540, feature selecting circuits 550, one or more filtering circuits 560 and an image data source 570. The controller 510 is linked to the other devices 520–570 by the data/control bus 512.

In a first mode of operation, the controller 510 creates output jobs by taking images from the image data source 570 and instructions from the feature selecting circuits 550 and exporting them to an image forming device 100 using the input/output interface 530 and the link 300. As an output job is processed by the image forming device 100, the user interface 500 can receive status information from the image forming device 100 via the link 300. The controller 510, using the input/output interface 530, receives the status information and places it in the memory 520. Subsequently, the controller 510 can determine a "ready/not ready" status indication using the filtering circuits 560 and display the status indication using the status display 540.

The exemplary embodiment of the status display and control system 500 shown in FIG. 3 can subsequently update the "ready/not ready" status indication periodically or by using an event driven scheme. For example, the image forming device 100 can be initially evaluated against a set of required features and return a "ready" indication. The image forming device 100 would not send any further information to the user interface 500 unless the status of the image forming device 100 changed, for example, if the image forming device 100 ran out of a consumable such as paper, staples or toner before finishing the output job.

In a second mode of operation, the status display and control system 500 can display detailed feature and status information derived from the image forming device 100. In this mode, the controller 510 again creates an output job by taking images from the image data source 570 and instructions from the feature selecting circuits 550 and exporting them to an image forming device 100 using the input/output interface 530 and the link 300. As an output job is processed by the image forming device 100, the user interface 500 can receive status information from the image forming device 100 via the link 300.

However, instead of determining a ready/not ready status indication, the controller 510 can display detailed information to an operator using the status display 540. For example, the controller 510 can display an icon-based representation of an image forming device's paper trays on the status display 540. Each of the paper trays can be represented by different graphics indicating features such as the paper tray's position and type and amount of paper contained by the paper tray. As each paper tray becomes empty or otherwise becomes unavailable, the graphic can change or a second graphic such as an "X" overlay can be superimposed to indicate unavailability. Furthermore, as each paper tray is currently used, the respective graphic can again be altered or a variant such as a blinking graphic of the same shape can indicate that the paper tray is presently used by an output job. Like the first mode of operation, the status display 540 can be updated periodically or by using an event driven scheme to reflect the status changes that occur throughout a print job.

It should be appreciated that, due to the possible complexity of an image forming device, several graphic compilations, or views, of the image forming device can be required. For example, a status display can have a first view relating to the status of the paper supply module 140 and the paths 150, 160 and 170. The first view can also include information about related consumables such as the different types of paper or envelopes in each paper tray 144, 146 and 148. The status display can further have other views relating to any component or group of components indicating the status of the components and availability of related consumables.

It should further be appreciated that the first two modes of operation can be combined to form a third mode of operation where the status display and control system 500 commands the image forming device 100 to report detailed feature and status information to the status display and control system 500 and the status display and control system 500 can present both a "ready/not ready" status indication and a detailed feature and status representation to an operator.

In various exemplary embodiments, the exemplary controller 510 is a general purpose computer. However, in other exemplary embodiments, the controller 510 can be a special purpose computer, a microprocessor or microcontroller, an ASIC or other integrated circuit, a digital signal processor, a hardwired electronic or logic circuit such as a discrete element circuit, a programmable logic device such as a PLD, PLA, FPGA or PAL, or the like without departing from the spirit and scope of this invention.

The memory 520 of the exemplary user interface 500 can be implemented using static or dynamic RAM. However, the memory 520 can also be implemented using a floppy disk and disk drive, a write-able optical disk and disk drive, a hard drive, flash memory or the like without departing from the spirit and scope of this invention. Furthermore, the memory 520 can be a persistent memory i.e. maintain information when external power is removed, or the memory 520 can be a volatile memory i.e. information is lost when power is removed.

In various exemplary embodiments, the input/output interface 530 of the exemplary embodiment is a network interface for a Local Area Network (LAN). However, in other exemplary embodiments, the input/output interface 530 can be any device suitable to send required feature instructions and to, to receive status and feature information from, any device, such as a copier, a digital copier, a scanner, a printer, a disk drive, a universal asynchronous receiver/transmitter (UART), a local area network (LAN), a wide area network (WAN), a parallel digital interface, a software interface or any combination of known or later developed software and hardware. While the input/output interface 530 is depicted as a single device in FIG. 3, it should be appreciated that the input and output functions can be separately accommodated by separate devices without departing from the spirit and scope of this invention.

The status display 540 can be any device capable of displaying a single ready status indication such as a cathode ray tube (CRT), a liquid crystal display (LCD), a light source or the like. If the user interface 500 is directed to display detailed status and capability information, then the status display 220 can be a cathode ray tube, a liquid crystal display, or any other device capable of displaying detailed feature and status information from an image forming device 100.

In various exemplary embodiments, the one or more feature selecting circuits 550 can include a display screen capable of displaying a number of graphical user interface selection widgets, such as check boxes, radio buttons, list boxes, pop-up or drop-down marks, or text entry boxes, such as those shown in the feature selecting graphical user interface 400 shown in FIG. 2, that an operator can access using one or more input devices, such as a computer keyboard, a computer mouse or the like. However, it should be appreciated that the one or more feature selecting circuits 550 can also or alternatively include any device capable of receiving or defining feature information such as a command line interface, a touch sensitive display, a keyboard, or a number of mechanical selection devices such as buttons and knobs or the like.

In various exemplary embodiments, the one or more filtering circuits 560 can be implemented using a software program residing on a memory and executed by the controller 510. However, it should be appreciated that the filtering circuits 560 can be implemented using any device or software program capable of receiving a set of required image forming device features along with a set of actual image forming device feature and status data, comparing the set of required features to the feature status data, and producing a "ready/not ready" signal indicating whether the image forming device 100 has all the required features and that every required feature is available. For example, the filtering device can return a "ready" signal if presented with information that an output job requires duplex printing and other information that a selected image forming device has a duplex printing capability. However, if the duplex printing feature is unavailable due to a problem such as a paper jam in the duplex printing path and the one or more filtering circuits 560 is presented with this information, the one or more filtering circuits 560 can return a "not ready" signal.

In various exemplary embodiments, the image data source 570 is a disk drive containing one or more images capable of being output by an image forming device 100. However, it should be appreciated that the image data source 570 can also be implemented by any device capable of storing, recalling, producing, deriving or relaying image information such as, a scanner, a digital copier, a facsimile machine, a remote node of a distributed network, a server, a floppy disk and disk drive, a writable optical disk and disk drive, a flash memory or the like, without departing from the spirit and scope of the present invention.

Figure 4A:
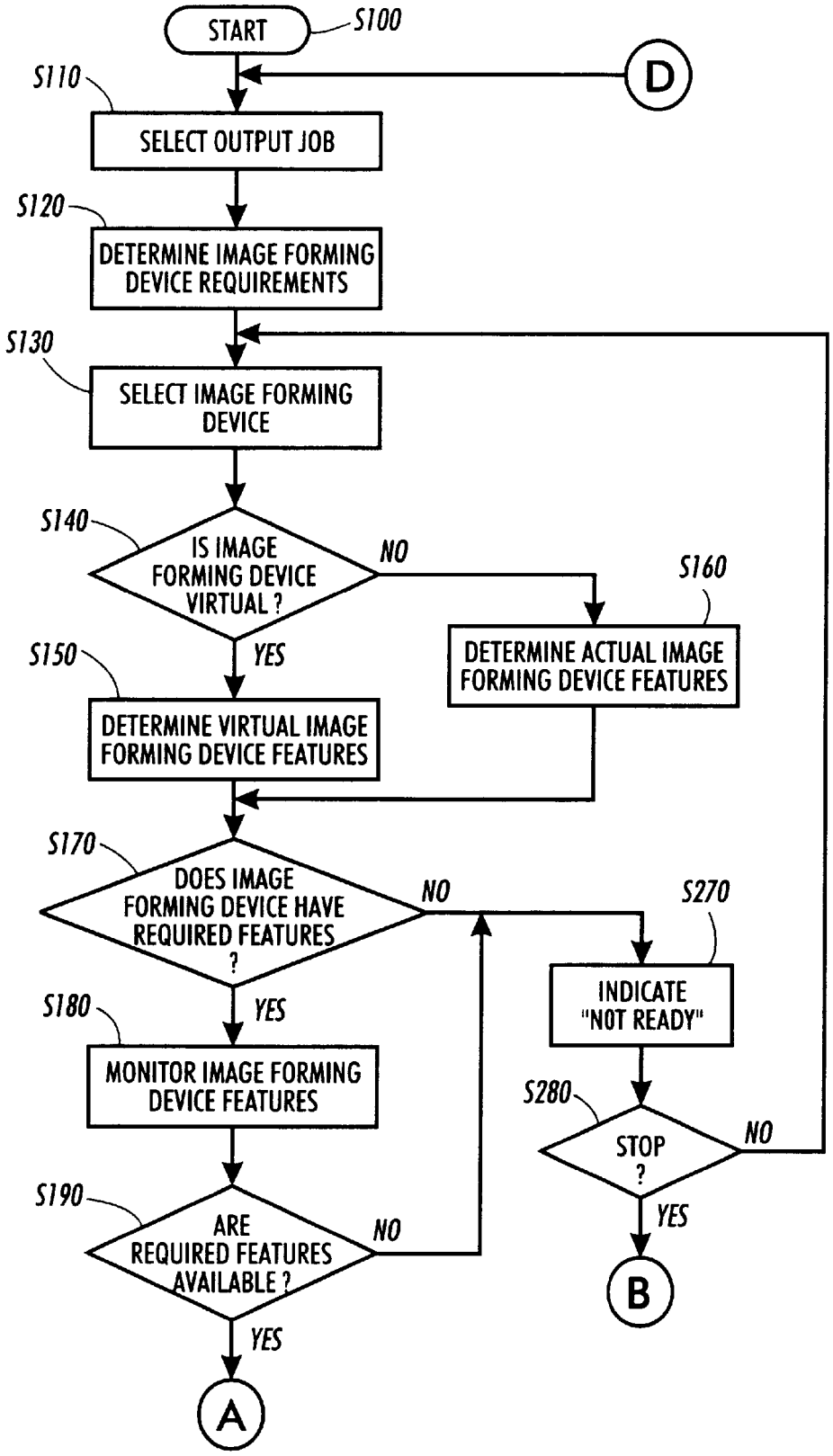
FIGS. 4A and 4B are a flowchart outlining one exemplary embodiment of the methods for producing status indication according to this invention.
Figure 4B:
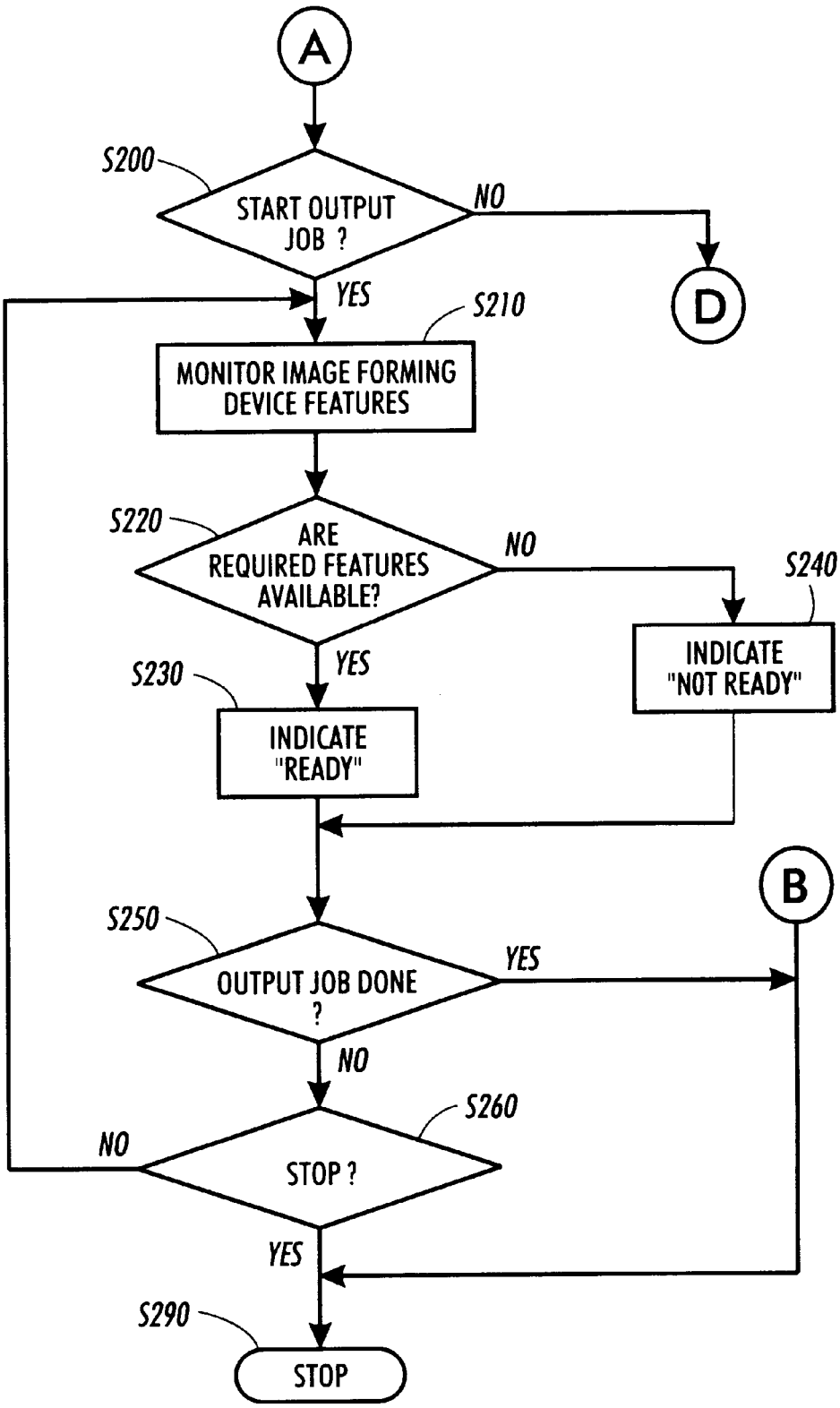

FIGS. 4A and 4B are a flowchart outlining one exemplary embodiment of a method for indicating status information of an image forming device according to this invention. Beginning in step S100, control continues to step S110, where an output job is selected. The output job can have one or more images that can be formed on an image bearing medium such as paper. Furthermore, the output job can have a set of instructions such as whether the one or more images are to be formed on one or both sides of the image bearing medium, whether the image bearing medium is to be stapled and how it will be stapled, whether the medium is to be collated, and the like.

Next, in step S120, the attributes of an image forming device required to complete the selected output job are determined. For example, an output job requiring double-sided printing requires an image forming device with a functional duplex printing feature. Other requirements, such as stapling and collating requirements, likewise require functional features, such as functional stapling and collating devices.

Then, in step S130, an image forming device is selected to process the output job. Next, in step S140, a determination is made whether the selected image forming device is a virtual image forming device or whether it is a real image forming device. If the image forming device is virtual, control continues to step S150. Otherwise, control jumps to step S160.

In step S150, the features of the virtual image forming device are determined. Control then jumps to step S170. In contrast, in step S160, because the image forming device is a real image forming device, the features of the real image forming device are determined. Control then jumps to step S170. In the exemplary method, the features of the real image forming device are determined using a file containing information about the features of the real image forming device. However, the features of the real image forming device can be determined by receiving information directly from the image forming device or by any other technique that can determine the features of a real image forming device without departing from the spirit and scope of the present invention.

In step S170, a determination is made whether the selected image forming device has all the determined required features. If the selected image forming device does not have all the determined required features, control continues to step S180. Otherwise, control jumps to step S270.

In step S180, the image forming device is monitored to determine what features contained in the image forming device are available for use. Next, in step S190, a determination is made whether all of the determined required features are available. If the required features are available, control continues to step S200, otherwise, control again jumps to step S270.

In step S200, a determination is made whether to start the output job. If the output job is to start, control continues to step S210. Otherwise, control returns to step S110.

In step S210, the required image forming device features are further monitored to determine the availability of those features. Next, in step S220, a determination is made as to whether the required features are all still available. If the required features are all still available, control continues to step S230, otherwise, control jumps to step S240.

In step S230, a "ready" status indication is presented to an operator. Control then jumps to step S250. In contrast, in step S240 a "not ready" indication is presented to a user. Then, in step S250, a determination is made whether the output job is finished. If the output job is finished, control jumps to step S290. Otherwise, control continues to step S260.

In step S260, a decision is made whether to stop the output job. If the output job is to be stopped, control jumps to step S290. Otherwise, control jumps back to step S230.

In contrast, in step S270, because the image forming device does not have all the required features or because not all of the determined required features were available, a "not ready" indication is presented to an operator. Next, in step S280, a determination is made whether the output job is to be stopped. If the output job is not to be stopped, control jumps back to step S530. Otherwise, control continues to step S290, where the method stops.

Figure 5A:
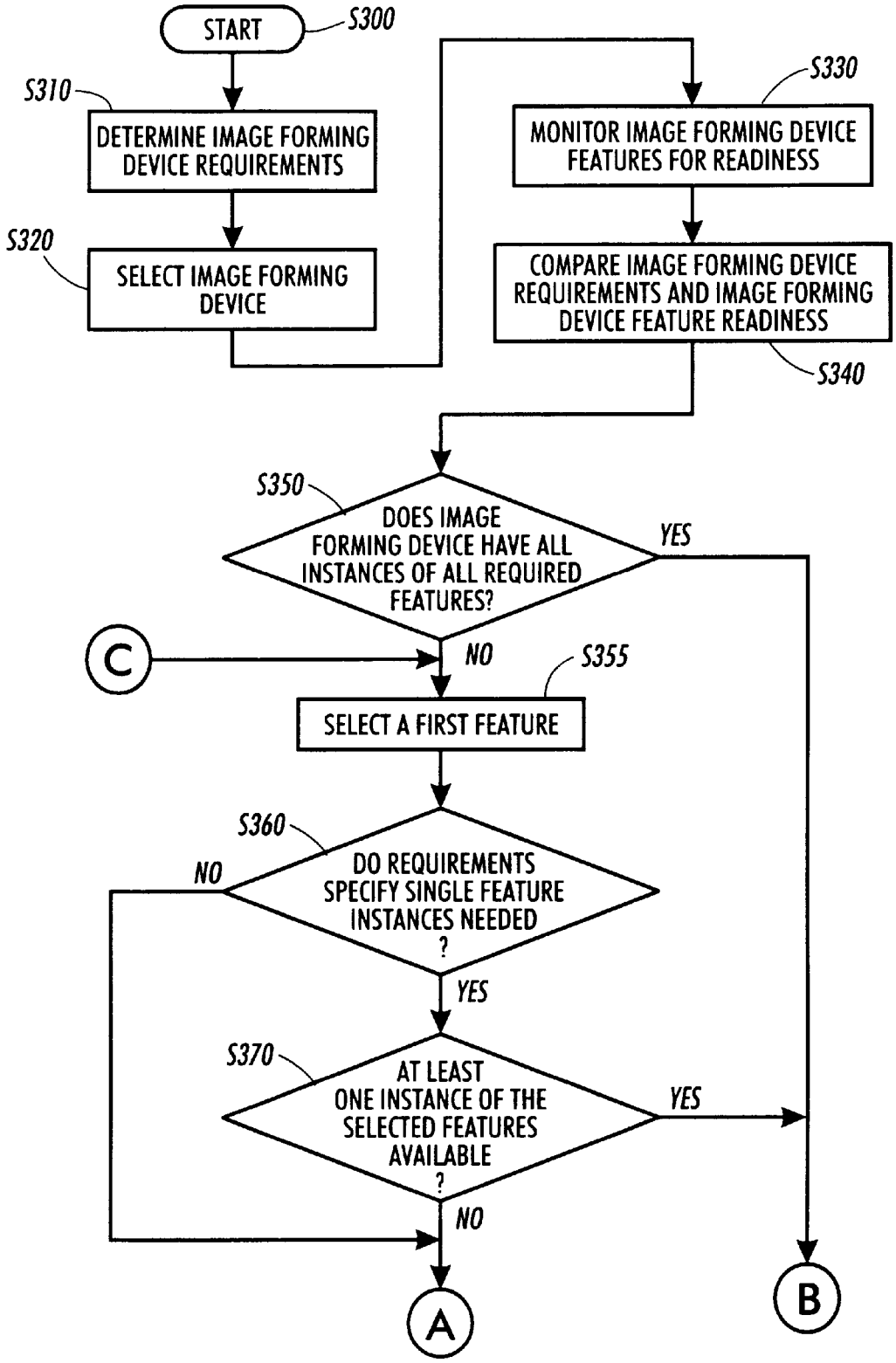
FIGS. 5A and 5B are a flowchart outlining another exemplary embodiment of the methods for producing a status indication according to this invention.
Figure 5B:
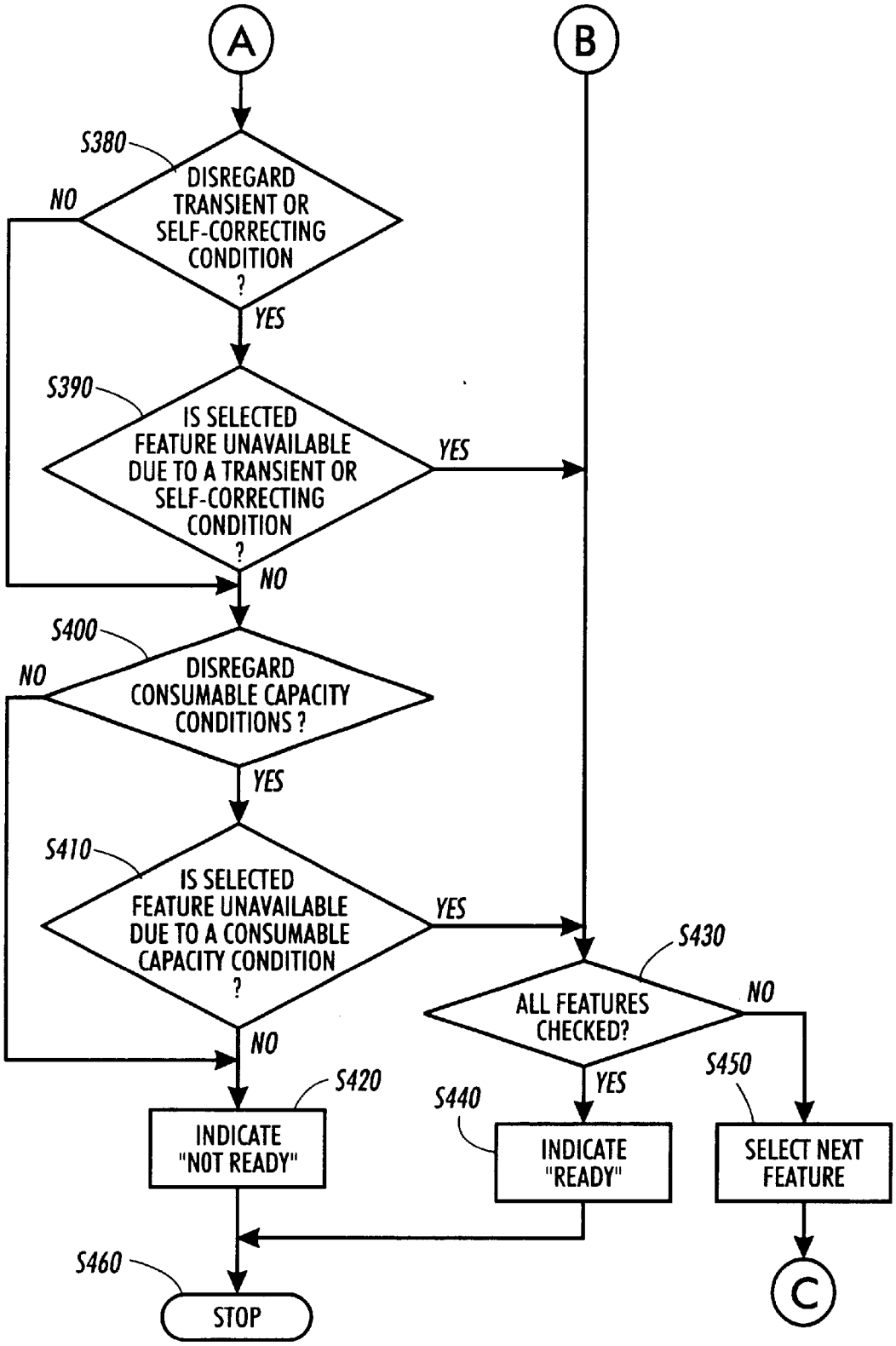

FIGS. 5A and 5B are a flowchart outlining another exemplary embodiment of a method for indicating status information of an image forming device according to this invention. Beginning in step S300, control continues to step S310, where the attributes of an image forming device required to complete a selected output job are determined. In addition to determining whether an output job requires features such as duplex printing, other considerations such as whether all instances of a required feature are required can be determined. For example, it can be desirable to require an image forming device to have all paper trays stocked or it can be desirable to require only a singe paper tray to be stocked. Additionally, for instances of the same feature, it can be desirable to require all such instances to be available. For example, for an image forming device with four A4 paper trays, an operator can require all A4 paper trays to be available or merely require a single A4 paper tray.

Other feature requirements can include considering or ignoring transient or self-correcting conditions such as delays due to temperature adjustments, considering or ignoring consumable capacity conditions such as paper supplies and the like. It should be appreciated that any feature or condition capable of being considered or ignored can be considered without departing from the spirit and scope of this invention. Control continues to step S320.

In step S320, an image forming device is selected. Next, in step S330, the features of the selected image forming device are monitored. Then, in step S340, the image forming device requirements are compared to the readiness of the image forming device features. Control continues to step S350.

In step S350, a determination is made whether every instance of a required feature of the selected image forming device is available. For example, if a print job requires A4 paper and the selected image forming device has one or more A4 paper sources, it can be desirable to require that all A4 paper sources be available. If every instance of a required feature of the selected image forming device is available, control jumps to step S430, otherwise, control continues to step S355.

In step S355, a first feature of the selected image forming device is selected for consideration. Next, in step S360, a determination is made whether the requirements determined in step S310 require only a single instance of the selected feature be available. For example, if a print job requires A4 paper and the selected image forming device has one or more A4 paper sources, it can be desirable to require only one A4 paper sources be available, even where the selected image forming device has multiple A4 paper sources. If the requirements determined in step S310 require only a single instance of the selected image forming device's features be available, control continues to step S370, otherwise, control jumps to step S380.

In step S370, a determination is made whether at least one instance of the selected feature is available. If at least one instance of the selected feature is available, control jumps to step S430, otherwise, control continues to step S380.

In step S380, a determination is made whether the requirements determined in step S310 specify disregarding transient or self-correcting conditions. For example, the toner module of an image forming device can be unavailable due to the temperature of the toner module being temporarily out of range. In this situation, the temperature of the toner module can be self-corrected and, thus, the unavailability condition of the toner module is transient. If the requirements specify disregarding transient or self-correcting conditions, control continues to step S390, otherwise, control jumps to step S400.

In step S390, a determination is made whether the selected feature is unavailable due to a transient or self-correcting condition. If the selected feature is unavailable due to a transient or self-correcting condition, control jumps to step S430, otherwise, control continues to step S400.

In step S400, a determination is made whether the requirements determined in step S310 specify disregarding consumable capacity conditions. For example, if a print job requires A4 paper, it can be desirable to disregard the availability condition of all A4 paper sources of an image forming device, as long as the image forming device has at least one paper source capable of accommodating A4 paper. If the requirements specify disregarding consumable capacity conditions, control continues to step 410, otherwise control jumps to step S420.

In step S410, a determination is made whether the selected feature is unavailability due to a consumable capacity condition. If the selected feature is unavailability due to a consumable capacity condition, control jumps to step S430, otherwise, control continues to step S420.

In step S420, a "not ready" status indication is presented to an operator. Control then continues to step S460. In contrast, in step S430, a determination is made as to whether all features of the selected image forming device have been checked. If all features of the selected image forming device have been checked, control continues to step S440, otherwise, control continues to step S450.

In step S440 a "ready" indication is presented to a user. Control then continues to step S460, where the method stops. In contrast, in step S450, another feature of the selected image forming device is selected for consideration and control jumps back to step S360. The method continues to loop through steps S360–S450 until all features of the selected image forming device have been considered and the method stops in step S460.

Figure 6A:
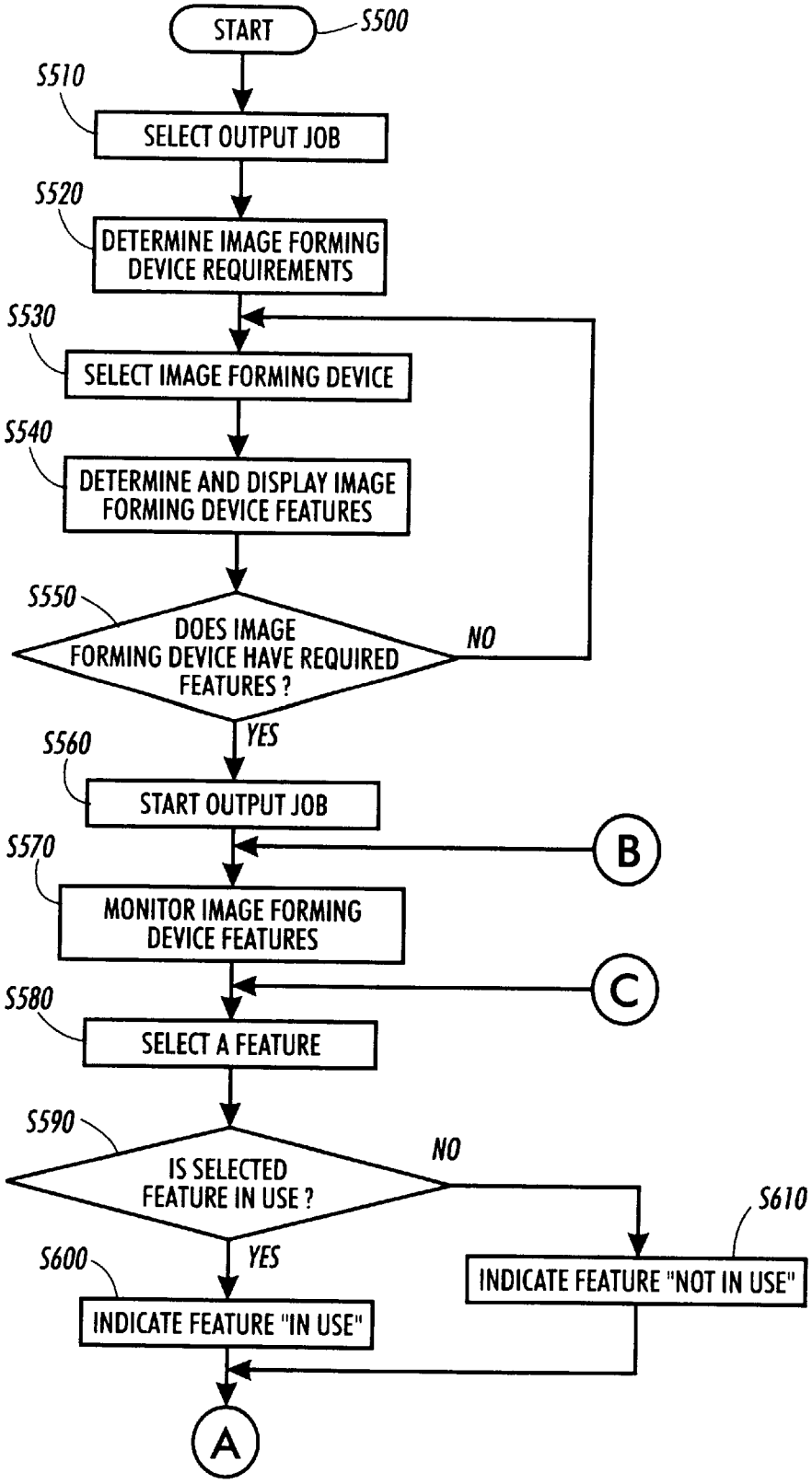
FIGS. 6A and 6B are a flowchart outlining one exemplary embodiment of the methods for displaying an image forming device's various features and the availability of the features according to this invention.
Figure 6B:
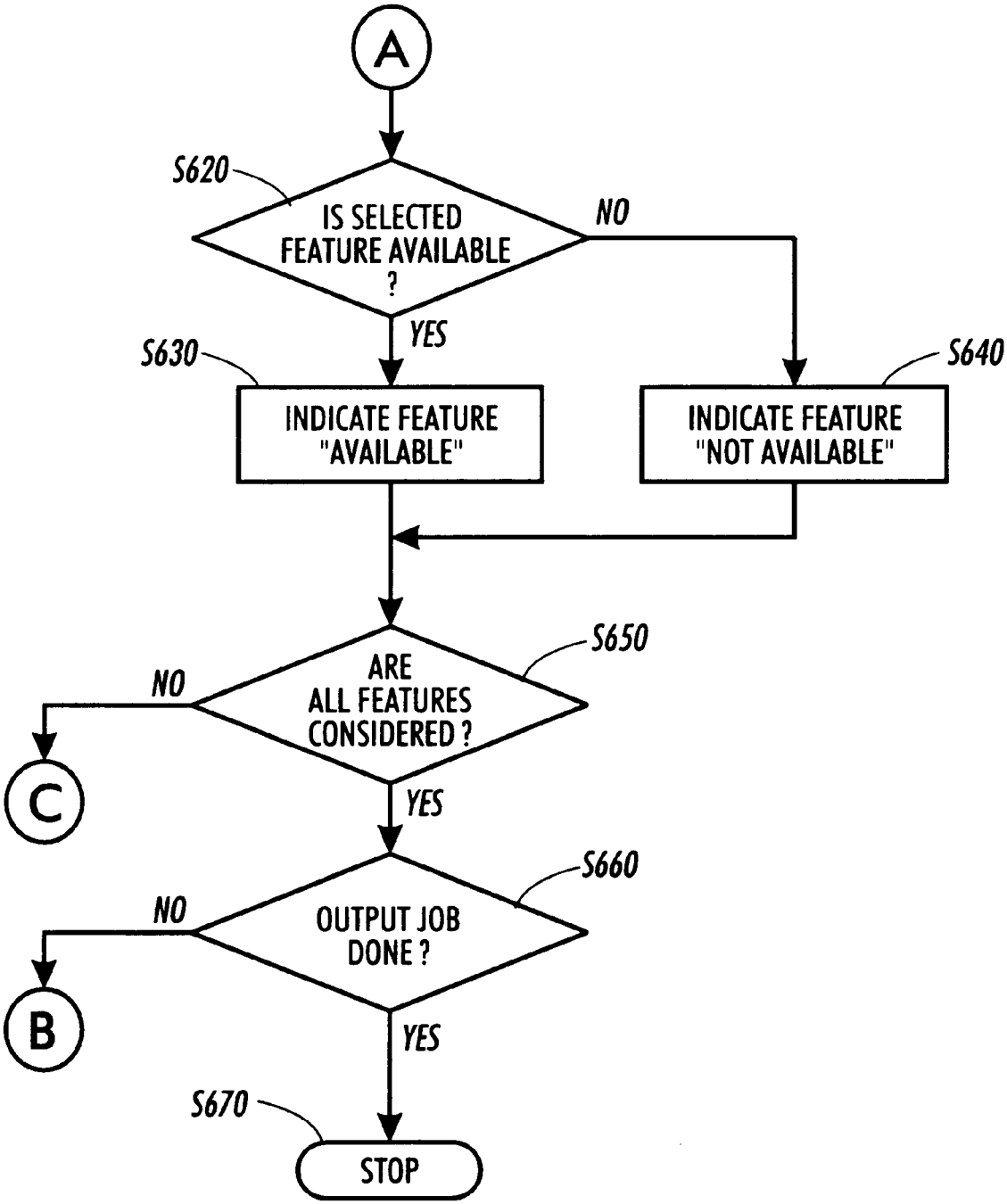

FIGS. 6A and 6B are a flowchart outlining one exemplary embodiment of the methods for displaying status information of an image forming device according to this invention. Beginning in step S500, control continues to step S510, where an output job, having one or more images and a set of image forming instructions, is selected. Then, in step S520, the features of an image forming device that are required to complete the selected output job are determined. Next, in step S530, an image forming device is selected to process the output job. Control then continues to step S540.

In step S540, the features of the selected image forming device are determined and displayed. The display can take the form of a pictorial or icon-based representation, a screen or panel with a number of indicators known or later developed, a textual display or the like. It should be appreciated that the display can take any known or later developed form capable of conveying feature information without departing from the spirit and scope of the present invention. Then, in step S550, a determination is made whether the selected image forming device has all the determined required features. If the selected image forming device has all the determined features, control continues to step S560. Otherwise, control jumps back to step S530.

In step S560, the output job is started. Next, in step S570, all of the image forming device features are monitored to determine whether each feature is presently used and whether each feature is available. Then, in step S580, one of the image forming device's features is selected to be displayed for use and availability. Control continues to step S590.

In step S590, a determination is made whether the selected feature is presently used by the selected image forming device. If the selected feature is presently used by the selected image forming device, control continues to step S600. Otherwise, control jumps to step S610.

In step S600, an indication is displayed that the selected feature is presently being used. Control then jumps to step S620. In contrast, in step S610, an indication is displayed that the selected feature is not in use. Next, in step S620, a determination is made whether the selected feature of the image forming device is available. If the selected feature is available, control continues to step S630, otherwise, control continues to step S640.

In step S630, an indication is displayed that the selected feature is available. Control then jumps to step S650. In contrast, in step S640, an indication is displayed that the selected feature is not available. Then in step S650, a determination is made whether every feature of the image forming device monitored in step S570 has been selected for display of use and availability status. If all the features of the image forming device have been considered and displayed, control continues to step S660. Otherwise, control jumps back to step S580, where the next feature of the image forming device is selected.

In step S660, a determination is made whether the output job is finished. If the output job is finished, control continues to step S670, where the operation stops. Otherwise, control jumps back to step S570, where the features of the image forming device are again monitored for use and availability.

In various exemplary embodiments of the systems and methods according to this invention, the image forming device 100 of FIG. 1 is a laser printer. However, it should be appreciated that the image forming device 100 can be a copier, a digital copier, a scanner, a fax machine, a thermal printer, an ink-jet printer or any other device capable of forming images, without departing from the spirit and scope of the present invention.

In the exemplary embodiment of the feature selection graphical user interface 400 shown in FIG. 2, the feature selection graphical user interface 400 is implemented using a programmed microcontroller and peripheral integrated circuit elements. However, the feature selection graphical user interface 400 can also be implemented on a general purpose computer, a special purpose computer an ASIC or other integrated circuit, a digital signal processor, a hardwired electronic or logic circuit such as a discrete element circuit, a programmable logic device such as a PLD, PLA, FPGA or PAL, or the like. In general, any device capable of implementing a finite state machine that is in turn capable of implementing the system of FIG. 2 and/or the flowcharts of FIGS. 4A–6B can be used to implement the feature selection graphical user interface 400.

In the exemplary embodiment of the status display and control system 500 shown in FIG. 3, the status display and control system 500 is implemented using a program microcontroller and peripheral integrated circuits including a display capable of displaying status information. However, the status display and control system 500 can also be implemented using a general purpose computer, a special purpose computer, an ASIC or other integrated circuit, a digital signal processor, a hardwired electronic or logic circuit such as a discrete element circuit, a programmable logic device such as a PLD, PLA, FPGA or PAL, or the like. In general, any device capable of implementing a finite state machine that is in turn capable of implementing the flowcharts of FIGS. 4A–6B can be used to implement the status display and control system 500.

It should be understood that each of the circuits shown in FIG. 3 can be implemented as portions of a suitably programmed general purpose computer. Alternatively, each of the circuits shown in FIG. 3 can be implemented as physically distinct hardware within an ASIC, or using an FPGA, a PLD, a PAL, or using discrete logic elements or discrete circuit elements. The particular form of each of these circuits shown in FIG. 3 will take is a design choice and will be obvious and predictable to those skilled in the art.

It should be further understood that the status display and control system 500 and the image forming device 100 as shown in FIGS. 1–3 can share resources and even be implemented as a single device. Furthermore, it should be appreciated that various circuits in the status display and control system 500 and the image forming device 100 can alternately reside in various other locations, such as a print server on a network and the like.

While this invention has been described in conjunction with the exemplary embodiments outlined above, it is evident that many alternatives, modifications, and variations will be apparent to those skilled in the art. Accordingly, the exemplary embodiments of the invention, as set forth above, are intended illustrative, not limiting. Various changes may be made without departing from the spirit and scope of the invention.

What is claimed is:

1. A status information control system that displays status information about an image forming device, comprising:

a memory that stores a set of status criteria and a set of status information for the image forming device corresponding to the set of status criteria;

a controller that compares the set of status information for the image forming device to the set of status criteria and that generates a status indication based on the comparison; and a display device, wherein the status indication is displayed on the display device;

wherein the status indication comprises a single ready status indication.

2. The system of claim 1 wherein the status indication further comprises a representation of at least one feature of the image forming device.

3. The system of claim 2, wherein the status indication further comprises a representation of an availability of at least one feature of the image forming device.

4. The system of claim 2, wherein the status indication further comprises a representation of a use of at least one feature of the image forming device.

5. The system of claim 1, wherein the status indication comprises a representation of at least one feature of the image forming device.

6. The system of claim 5, wherein the status indication further comprises a representation of an availability of at least one feature of the image forming device.

7. The system of claim 6, wherein the status indication further comprises a representation of an use of at least one feature of the image forming device.

8. The system of claim 1, wherein the set of status criteria is based on one of a default user file, a default group file, a virtual printer file, a saved ticket and a hot folder.

9. The apparatus of claim 1, wherein the image forming device is a virtual image forming device.

10. A method of providing status information about an image forming device, comprising:

storing a set of status criteria for the image forming device;

storing a set of status information for the image forming device corresponding to the set of status criteria;

comparing the set of status information for the image forming device to the set of status criteria;

determining a status indication based on the comparison; and displaying the status indication;

wherein the status indication comprises a single ready status indication.

11. The method of claim 10, wherein the status indication further comprises a representation of at least one feature of the image forming device.

12. The method of claim 11, wherein the status indication further comprises a representation of an availability of at least one feature of the image forming device.

13. The method of claim 11, wherein the status indication further comprises a representation of a use of at least one feature of the image forming device.

14. The method of claim 10, wherein the status indication comprises a representation of at least one feature of the image forming device.

15. The method of claim 14, wherein the status indication further comprises a representation of an availability of at least one feature of the image forming device.

16. The method of claim 10, wherein the set of status criteria is based on one of a default user file, a default group file, a virtual printer file, a saved ticket and a hot folder.

17. The method of claim 10, wherein the image forming device is a virtual image forming device.

* * * * *